US007165446B2

(12) United States Patent
Miyahara et al.

(10) Patent No.: US 7,165,446 B2
(45) Date of Patent: Jan. 23, 2007

(54) FAILURE DIAGNOSTIC APPARATUS FOR FUEL VAPOR PURGE SYSTEM AND FUEL VAPOR PURGE APPARATUS AND COMBUSTION ENGINE HAVING FAILURE DIAGNOSTIC APPARATUS

(75) Inventors: Hideki Miyahara, Nishikamo-gun (JP); Tokiji Ito, Toyota (JP); Kenji Nagasaki, Nagoya (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 36 days.

(21) Appl. No.: 11/099,479

(22) Filed: Apr. 6, 2005

(65) Prior Publication Data

US 2005/0229688 A1 Oct. 20, 2005

(30) Foreign Application Priority Data

Apr. 14, 2004 (JP) ..... 2004-119050

(51) Int. Cl.
*G01M 19/00* (2006.01)

(52) U.S. Cl. ..... 73/118.1; 73/49.7; 73/115; 73/116; 73/117.2; 73/117.3; 73/119 R; 73/40; 73/46; 73/47

(58) Field of Classification Search ..... 73/40–49.7, 73/115–118.1
See application file for complete search history.

(56) References Cited

U.S. PATENT DOCUMENTS

| | | | | |
|---|---|---|---|---|
| 5,679,890 | A * | 10/1997 | Shinohara et al. | 73/118.1 |
| 6,357,288 | B1 * | 3/2002 | Shigihama et al. | 73/118.1 |
| 6,651,491 | B1 * | 11/2003 | Saito et al. | 73/117.3 |
| 6,817,232 | B1 * | 11/2004 | Amano et al. | 73/118.1 |
| 2006/0191330 | A1 * | 8/2006 | Hayakawa et al. | 73/118.1 |

FOREIGN PATENT DOCUMENTS

| | | |
|---|---|---|
| JP | 2003-254172 | 9/2003 |
| JP | 2003-269265 | 9/2003 |

* cited by examiner

*Primary Examiner*—Edward Lefkowitz
*Assistant Examiner*—Jermaine Jenkins
(74) *Attorney, Agent, or Firm*—Kenyon & Kenyon LLP

(57) ABSTRACT

After a reference pressure using a reference hole is measured, a pressure in an evaporation path is measured. An ECU conducts failure diagnosis using, as a determination pressure for diagnosing presence/absence of a failure, a value obtained by correcting the reference pressure using the reference hole in a manner lowering the same by a predetermined amount, taking into account pressure lowering in the evaporation path due to condensation of fuel vapor at the time of adsorption in a canister when a vapor concentration in the evaporation path is high.

8 Claims, 5 Drawing Sheets

| | | PRESSURE (kPa) | | | |
|---|---|---|---|---|---|
| | | 60 | 80 | 100 | 110 |
| TEMPERATURE (°C) | 10 | −0.3kPa | −0.2kPa | −0.1kPa | 0kPa |
| | 25 | −0.4kPa | −0.3kPa | −0.2kPa | −0.1kPa |
| | 40 | −0.5kPa | −0.4kPa | −0.3kPa | −0.2kPa |

| | | PRESSURE (kPa) | | | |
|---|---|---|---|---|---|
| | | 60 | 80 | 100 | 110 |
| TEMPERATURE (℃) | 10 | -3% | -2% | -1% | 0% |
| | 25 | -4% | -3% | -2% | -1% |
| | 40 | -5% | -4% | -3% | -2% |

FAILURE DIAGNOSTIC APPARATUS FOR FUEL VAPOR PURGE SYSTEM AND FUEL VAPOR PURGE APPARATUS AND COMBUSTION ENGINE HAVING FAILURE DIAGNOSTIC APPARATUS

This nonprovisional application is based on Japanese Patent Application No. 2004-119050 filed with the Japan Patent Office on Apr. 14, 2004, the entire contents of which are hereby incorporated by reference.

BACKGROUND OF THE INVENTION

1. Field of the Invention

The present invention relates to a failure diagnostic apparatus for a fuel vapor purge system that purges fuel vapor generated in a fuel tank into an intake system and, to a fuel vapor purge apparatus and a combustion engine having the failure diagnostic apparatus.

2. Description of the Background Art

Vehicles with a fuel tank containing volatile liquid fuel generally have a fuel vapor purge system for purging fuel vapor generated in the fuel tank into an intake system. With such a fuel vapor purge system, the fuel vapor generated in the fuel tank is temporarily adsorbed and collected by a canister connected via a vapor passage to the fuel tank and thereafter purged into an air intake passage of an engine connected via a purge passage to the canister.

Most of fuel vapor purge systems of the above-described type have, with the purpose of ensuring the system reliability, a failure diagnostic apparatus for detecting leakage of fuel vapor due to opening of some hole(s) or crack(s) for example of a path including the fuel tank, vapor passage, canister, and purge passage (this path is hereinafter referred to as "evaporation path"). Such a failure diagnostic apparatus uses an electric pump to generate a pressure difference between the inside and the outside of the evaporation path, measures the pressure within the evaporation path, and compares the measured pressure with a predetermined reference pressure to conduct diagnosis for determining whether or not leakage from the evaporation path occurs.

Japanese Patent Laying-Open No. 2003-269265 discloses a failure diagnostic apparatus for a fuel vapor purge system like the aforementioned one. In consideration of influences of the generation of fuel vapor on the internal pressure of the evaporation path, the failure diagnostic apparatus uses a reference pressure that is generated when a pressure is applied to a reference hole having its diameter equal to the diameter of a hole which will cause an abnormality to be detected, the reference pressure being corrected using a pressure detected in advance when the fuel vapor is generated. The corrected reference pressure is used to determine whether or not leakage from the evaporation path occurs.

The failure diagnostic apparatus disclosed in Japanese Patent Laying-Open No. 2003-269265 can thus be used to improve precision with which whether or not leakage failure of the evaporation path occurs is determined.

On the other hand, in the failure diagnostic apparatus disclosed in Japanese Patent Laying-Open No. 2003-269265, influence on the internal pressure within the evaporation path due to condensation of the fuel vapor in the canister is not taken into account. Specifically, when the fuel vapor is adsorbed by the canister, the fuel vapor is condensed and its volume is reduced. Therefore, the internal pressure within the evaporation path is lowered. If the pressure in the evaporation path is set to a negative pressure at the time of failure diagnosis, the failure diagnostic apparatus disclosed in Japanese Patent Laying-Open No. 2003-269265 misdiagnoses abnormal as normal, because the pressure within the evaporation path is measured lower due to condensation of the fuel vapor in spite of presence of a hole to be detected in the evaporation path.

SUMMARY OF THE INVENTION

From the foregoing, the present invention was made to solve the above-described problems. An object of the present invention is to provide a failure diagnostic apparatus for a fuel vapor purge system taking into account an influence of pressure lowering within an evaporation path due to condensation of fuel vapor in a canister.

Another object of the present invention is to provide a fuel vapor purge apparatus including the failure diagnostic apparatus for a fuel vapor purge system taking into account an influence of pressure lowering within the evaporation path due to condensation of fuel vapor in the canister.

Yet another object of the present invention is to provide a combustion engine including the failure diagnostic apparatus for a fuel vapor purge system taking into account an influence of pressure lowering within the evaporation path due to condensation of fuel vapor in the canister.

According to the present invention, a failure diagnostic apparatus for a fuel vapor purge system adsorbing in a canister fuel vapor generated in a fuel tank and purging the adsorbed fuel vapor into an intake system includes: a pressure difference generation unit for generating, when failure diagnosis is executed, a pressure difference between respective pressures inside and outside a fuel vapor path including the fuel tank and the canister; a failure diagnostic unit for comparing, with a predetermined determination pressure, the pressure inside the fuel vapor path when the pressure difference generation unit generates the pressure difference, for conducting the failure diagnosis to determine whether failure occurs or not based on result of the comparison; and a correction unit for correcting the predetermined determination pressure in a manner lowering the predetermined determination pressure when a concentration of the fuel vapor within the fuel vapor path is higher than a predetermined value.

In addition, according to the present invention, a failure diagnostic apparatus for a fuel vapor purge system adsorbing in a canister fuel vapor generated in a fuel tank and purging the adsorbed fuel vapor into an intake system includes: a pressure difference generation unit for generating, when failure diagnosis is executed, a pressure difference between respective pressures inside and outside a fuel vapor path including the fuel tank and the canister; a failure diagnostic unit for comparing, with a predetermined determination pressure, the pressure inside the fuel vapor path when the pressure difference generation unit generates the pressure difference, for conducting the failure diagnosis to determine whether failure occurs or not based on result of the comparison; and a correction unit for correcting a measured pressure value within the fuel vapor path in a manner increasing the measured pressure value when a concentration of the fuel vapor within the fuel vapor path is higher than a predetermined value.

Moreover, according to the present invention, a failure diagnostic apparatus for a fuel vapor purge system adsorbing in a canister fuel vapor generated in a fuel tank and purging the adsorbed fuel vapor into an intake system includes: a pressure difference generation unit for generating, when failure diagnosis is executed, a pressure difference between respective pressures inside and outside a fuel vapor path including the fuel tank and the canister in accordance with a drive command; a failure diagnostic unit for comparing, with a predetermined determination pressure, the pressure inside the fuel vapor path when the pressure difference generation unit generates the pressure difference, for conducting the failure diagnosis to determine whether failure occurs or not based on result of the comparison; and a correction unit for correcting the drive command for the pressure difference generation unit in a manner lowering the pressure difference generated by the pressure difference generation unit when a concentration of the fuel vapor within the fuel vapor path is higher than a predetermined value.

Preferably, the pressure difference generation unit includes an air pump, and the correction unit corrects a revolution number command for the air pump in a manner lowering the number of revolutions of the air pump when the concentration of the fuel vapor within the fuel vapor path is higher than the predetermined value.

Preferably, the correction unit increases a correction amount as a temperature is higher.

Preferably, the correction unit increases a correction amount as a pressure within the fuel vapor path is lower.

Preferably, the failure diagnostic apparatus for a fuel vapor purge system further includes concentration detection unit for detecting a concentration of the fuel vapor within the fuel vapor path. The correction unit determines whether or not the concentration of the fuel vapor within the fuel vapor path is higher than the predetermined value based on a value detected by the concentration detection unit.

Preferably, the correction unit increases a correction amount as the value detected by the concentration detection unit is larger.

Preferably, the pressure difference generation unit generates a negative pressure, relative to outside air, within the fuel vapor path.

According to the present invention, a fuel vapor purge apparatus includes the failure diagnostic apparatus for the fuel vapor purge system as described above.

According to the present invention, a combustion engine includes the failure diagnostic apparatus for the fuel vapor purge system as described above.

In the failure diagnostic apparatus for the fuel vapor purge system according to the present invention, the correction unit corrects the determination pressure for failure diagnosis in a manner lowering the same when the concentration of the fuel vapor within the evaporation path is higher than the predetermined value. Therefore, pressure lowering within the evaporation path due to condensation of the fuel vapor at the time of adsorption of the fuel vapor in the canister is compensated for.

Therefore, according to the present invention, misdiagnosis due to pressure lowering within the evaporation path caused by condensation of the fuel vapor in the canister can be prevented.

In addition, in the failure diagnostic apparatus for the fuel vapor purge system according to the present invention, the correction unit corrects the drive command for the pressure difference generation unit in a manner lowering the drive force of the pressure difference generation unit when the concentration of the fuel vapor within the evaporation path is higher than the predetermined value. Therefore, pressure lowering in the evaporation path due to condensation of the fuel vapor at the time of adsorption of the fuel vapor in the canister is compensated for.

Therefore, according to the present invention as well, misdiagnosis due to pressure lowering in the evaporation path caused by condensation of the fuel vapor in the canister can be prevented.

Moreover, in the failure diagnostic apparatus for the fuel vapor purge system according to the present invention, the correction unit modifies a correction amount based on a temperature or a pressure in the fuel vapor purge system. In an environment where a larger amount of fuel vapor is generated, the correction amount is increased.

Therefore, according to the present invention, determination accuracy in failure diagnosis can be enhanced and further accurate failure diagnosis can be carried out.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
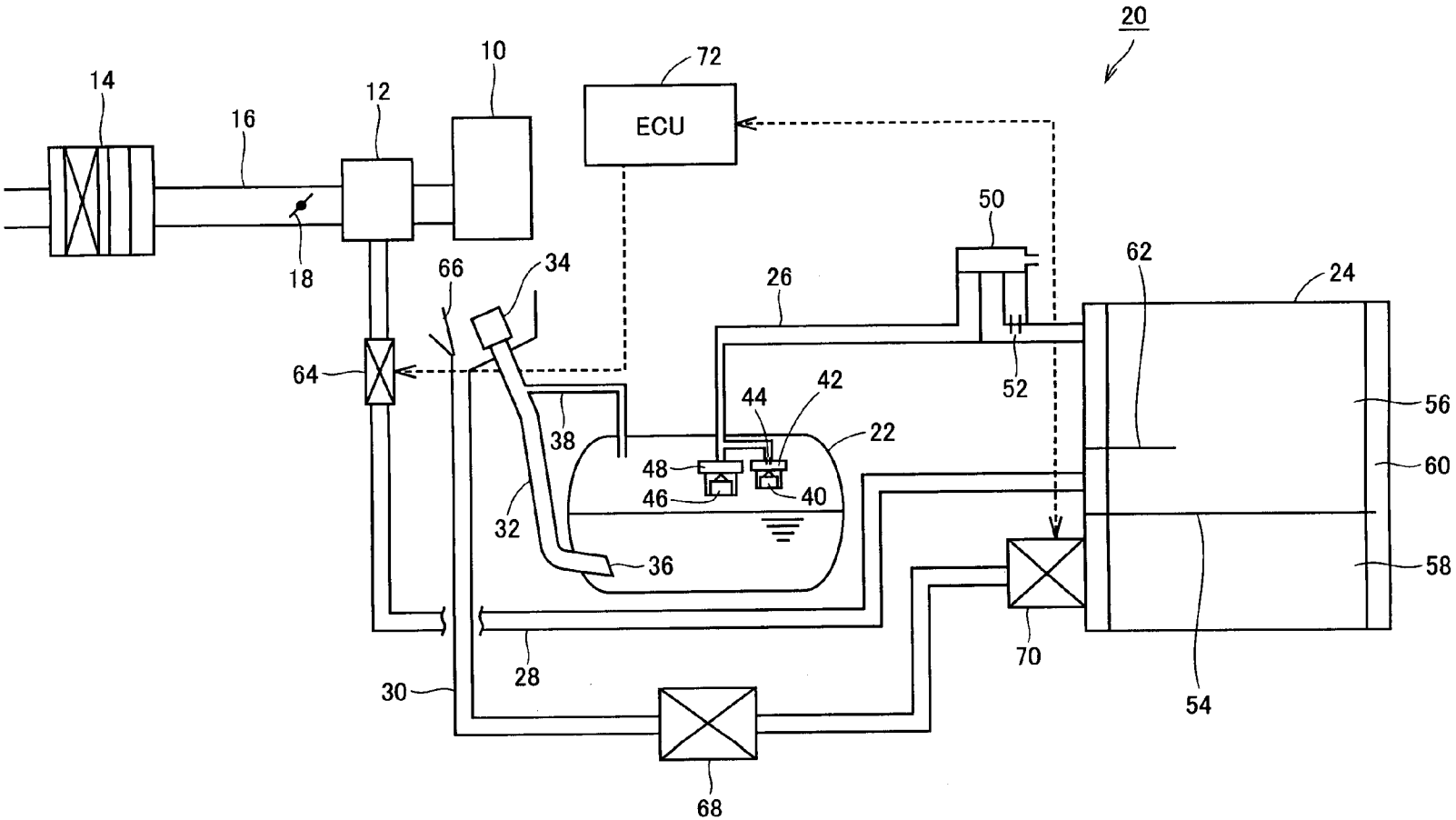
FIG. 1 schematically shows a structure of a fuel vapor purge system having a failure diagnostic apparatus according to the present invention.

Embodiments of the present invention are hereinafter described in detail with reference to the drawings. Like components in the drawings are denoted by like reference characters and a description thereof is not repeated here.

First Embodiment

FIG. 1 schematically shows a structure of a fuel vapor purge system having a failure diagnostic apparatus according to the present invention.

Referring to FIG. 1, fuel vapor purge system 20 includes a fuel tank 22, a canister 24, a vapor passage 26, a purge passage 28, an internal pressure valve 50, a purge control valve 64, an atmosphere intake passage 30, a dust filter 68, an electric pump module 70, and an ECU (Electronic Control Unit) 72. Fuel tank 22 is connected via vapor passage 26 to canister 24. Canister 24 is connected via purge passage 28 to a surge tank 12. Internal pressure valve 50 is provided on vapor passage 26 and purge control valve 64 is provided on purge passage 28. Atmosphere intake passage 30 is connected via electric pump module 70 to canister 24 and dust filter 68 is provided on atmosphere intake passage 30.

An engine 10 supplied with fuel by this fuel vapor purge system 20 is connected to surge tank 12. Surge tank 12 is connected to an air intake passage 16 directing intake air to engine 10 and further connected to purge passage 28 to mix fuel vapor supplied from purge passage 28 with the intake air from air intake passage 16 and supply the mixture to engine 10. A throttle valve 18 is provided upstream from surge tank 12 on air intake passage 16, and an air cleaner 14 is provided further upstream therefrom.

Fuel tank 22 includes float valves 40, 46, liquid pools 42, 48 and a throttle 44. Float valve 40, liquid pool 42 and throttle 44 are connected to the upper wall of fuel tank 22 and connected to one of branches, in fuel tank 22, of vapor passage 26. Float valve 46 and liquid pool 48 are connected to the other branch of vapor passage 26.

Fuel tank 22 is connected to an oil feed pipe 32. An oil inlet of oil feed pipe 32 has a cap 34 and an outlet of oil feed pipe 32 has a check valve 36. A circulation path 38 branches from oil feed pipe 32, and an opening end of circulation path 38 is located in an upper space in fuel tank 22.

Vapor passage 26 is a passage for delivering fuel vapor generated in fuel tank 22 to canister 24. Internal pressure valve 50 is provided in the vicinity of canister 24 on vapor passage 26 and has in itself a diaphragm and a throttle 52. When the internal pressure of fuel tank 22 is lower than a valve-opening pressure of internal pressure valve 50, the diaphragm is at a valve-closing position so that internal pressure valve 50 connects fuel tank 22 to canister 24 via throttle 52: When the internal pressure of fuel tank 22 then reaches the valve-opening pressure of internal pressure valve 50, the diaphragm moves to a valve-opening position so that internal pressure valve 50 connects fuel tank 22 to canister 24, not via throttle 52.

Canister 24 includes an adsorbent for adsorbing, by the adsorbent, the fuel vapor supplied via vapor passage 26 from fuel tank 22 and temporarily stores the fuel vapor. When surge tank 12 connected via purge passage 28 to canister 24 applies a negative pressure to canister 24, canister 24 discharges (purges) the fuel vapor adsorbed by the adsorbent into surge tank 12 via purge passage 28.

Canister 24 includes a partition plate 54, adsorbent chambers 56, 58, a ventilation filter 60, and a guide 62. Adsorbent chambers 56, 58 are filled with the adsorbent, separated by partition plate 54, and connected to each other via ventilation filter 60. Adsorbent chamber 56 is connected via vapor passage 26 to fuel tank 22 and also connected via purge passage 28 to surge tank 12. Adsorbent chamber 58 is connected via atmosphere intake passage 30 to the outside. Guide 62 is provided to permit the fuel vapor flowing from fuel tank 22 via vapor passage 26 into canister 24 to be adsorbed temporality by the adsorbent and thereafter purged into purge passage 28.

Purge control valve 64 operates in response to a control command from ECU 72. When purge control valve 64 opens, a negative pressure generated in surge tank 12 while engine 10 is running is applied via purge passage 28 into canister 24.

Atmosphere intake passage 30 is a passage for supplying, via electric pump module 70 into canister 24, air entering from an inlet opening 66 provided at an opening used for feeding oil. Dust filter 68 removes dust particles included in the air supplied from inlet opening 66.

Electric pump module 70 includes an electric air pump, a switching valve, a reference hole, and a pressure sensor (these are not shown). Electric pump module 70 operates in response to a control command from ECU 72. While engine 10 is running, electric pump module 70 connects canister 24 to atmosphere intake passage 30 without operating the electric air pump.

When failure diagnosis is performed on fuel vapor purge system 20, electric pump module 70 operates the electric air pump in response to a control command from ECU 72 to generate a negative pressure in the reference hole and canister 24. Electric pump module 70 then detects with the pressure sensor the pressure in the reference hole and canister 24 when the negative pressure is generated, and outputs the detected pressure values to ECU 72. The operation of fuel vapor purge system 20 when the failure diagnosis is performed thereon is hereinafter described in detail.

ECU 72 includes a CPU (Central Processing Unit), an ROM (Read Only Memory), an RAM (Random Access Memory), an A/D (Analog/Digital) converter, and an input/output interface for example. Based on such information detected by various sensors (not shown) as the number of revolutions of engine 10, amount of intake air, air-fuel ratio of an exhaust system, and vehicle speed, ECU 72 carries out such various types of control concerning operation of engine 10 as fuel injection control. Further, ECU 72 controls purge control valve 64 and controls purging of fuel vapor purge system 20. Furthermore, ECU 72 controls electric pump unit 70 to perform failure diagnosis on fuel vapor purge system 20 based on the detected values of the pressure from the pressure sensor of electric pump unit 70.

In this fuel vapor purge system 20, fuel vapor generated in fuel tank 22 while engine 10 is running flows into canister 24 via vapor passage 26 to be adsorbed temporarily by the adsorbent in canister 24. When purge control valve 64 opens in response to a control command from ECU 72, an intake air negative pressure is applied from surge tank 12 via purge passage 28 into canister 24. Then, the fuel vapor adsorbed in canister 24 is purged from canister 24 via purge passage 28 into surge tank 12.

The failure diagnosis for fuel vapor purge system 20 will now be described. Electric pump module 70 and ECU 72 constitute the failure diagnostic apparatus for fuel vapor purge system 20. When the failure diagnosis is conducted on fuel vapor purge system 20, electric pump module 70 first moves the switching valve based on a control command from ECU 72 to form a path comprised of atmosphere intake passage 30, the electric air pump, the reference hole, and atmosphere intake passage 30. Electric pump module 70 then drives the electric air pump based on a control command from ECU 72 to generate a negative pressure in the reference hole. Electric pump module 70 thereafter detects with the pressure sensor a first pressure between the electric air pump and the reference hole to output the detected first pressure to ECU 72.

The reference hole is made equal in size to a hole to be detected in the evaporation passage of fuel vapor purge system.20, and a first pressure detected at this time by the pressure sensor serves as a reference pressure for deciding a determination pressure for failure diagnosis in ECU 72.

In succession, electric pump module 70 moves the switching valve based on the control command from ECU 72, so as to form a path comprised of canister 24, the electric air pump, and atmosphere intake passage 30. Thereafter, electric pump module 70 drives the electric air pump based on the control command from ECU 72, so as to generate a negative pressure in the evaporation path. Then, electric pump module 70 detects a second pressure in the evaporation path with the pressure sensor, and outputs the detected second pressure to ECU 72.

ECU 72 starts failure diagnosis after a predetermined time period (five hours, for example) has passed after stop of engine 10 and the vehicle. ECU 72 outputs an operation command for the electric air pump and the switching valve to electric pump module 70, and receives the above-described first pressure from the pressure sensor in electric pump module 70. In addition, in order to estimate a vapor concentration status in the evaporation path, ECU 72 obtains a temperature and a pressure of fuel vapor purge system 20 detected by a not-shown engine water temperature meter and a system pressure sensor respectively.

Then, ECU 72 estimates a vapor concentration status in the evaporation path based on the detected temperature and the pressure. If it is estimated that the vapor concentration is high, a value obtained by correcting the reference pressure using the reference hole received as the first pressure in a manner lowering the same is employed as the determination pressure for failure diagnosis. In other words, when the vapor concentration in the evaporation path is high, pressure lowering due to volume reduction of the fuel vapor caused by adsorption in canister 24 takes place. Consequently, even if a hole larger than the reference hole is present, a measured pressure in the evaporation path is detected as lower than the reference pressure, resulting in misdiagnosis of fuel vapor purge system 20 as normal. ECU 72, however, decides the determination pressure by correcting the reference pressure using the reference hole if the vapor concentration is estimated as high.

Then, ECU 72 compares the second pressure detected when the negative pressure is generated in the evaporation path with the determination pressure, and carries out failure diagnosis based on a result of comparison.

While the failure diagnosis is performed on fuel vapor purge system 20, ECU 72 outputs a control command to purge control valve 64 to close purge control valve 64, so that the inside of the evaporation path is a closed space.

It is noted that, in the foregoing description, electric pump module 70 corresponds to the "pressure difference generation means."

Figure 2:
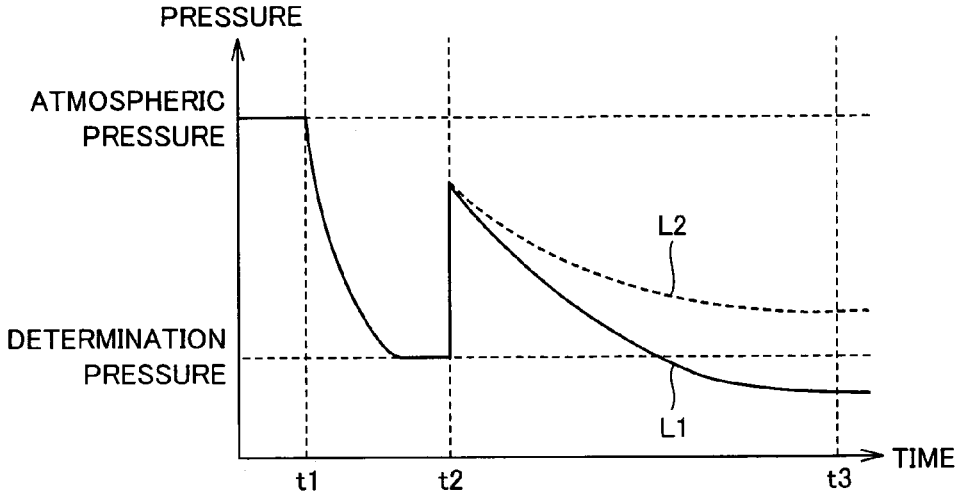
FIG. 2 shows a change in pressure when failure diagnosis is performed on the fuel vapor purge system.

FIG. 2 shows a change in pressure when failure diagnosis is performed on fuel vapor purge system 20. In FIG. 2, a change in pressure while the evaporation path is in a normal state is shown with a solid line L1, while a change in pressure while the evaporation path is in an abnormal state (hole is present) is shown with a dotted line L2. In addition, FIG. 2 shows pressure change when the vapor concentration in the evaporation path is low and correction of the determination pressure depending on the vapor concentration in the evaporation path is not performed.

Referring to FIG. 2, at time t1, failure diagnosis is started. Electric pump module 70 starts measurement of the reference pressure using the reference hole, in response to the control command from ECU 72. Then, ECU 72 employs, as the reference pressure for failure diagnosis, a pressure when variation in a detected pressure value received from electric pump module 70 is sufficiently small, and adopts this reference pressure as the determination pressure for failure diagnosis in the example shown in FIG. 2 where the vapor concentration in the evaporation path is low.

At time t2, electric pump module 70 starts application of the negative pressure to the evaporation path in response to the control command from ECU 72. When the evaporation path is in the normal state, that is, when a hole larger than the reference hole is not present in the evaporation path, the pressure in the evaporation path falls below the determination pressure. Here, ECU 72 diagnoses the evaporation path as normal. On the other hand, when the evaporation path is in the abnormal state, that is, when a hole larger than the reference hole is present in the evaporation path, the pressure in the evaporation path does not fall below the determination pressure. Here, ECU 72 diagnoses the evaporation path as abnormal.

Figure 3:
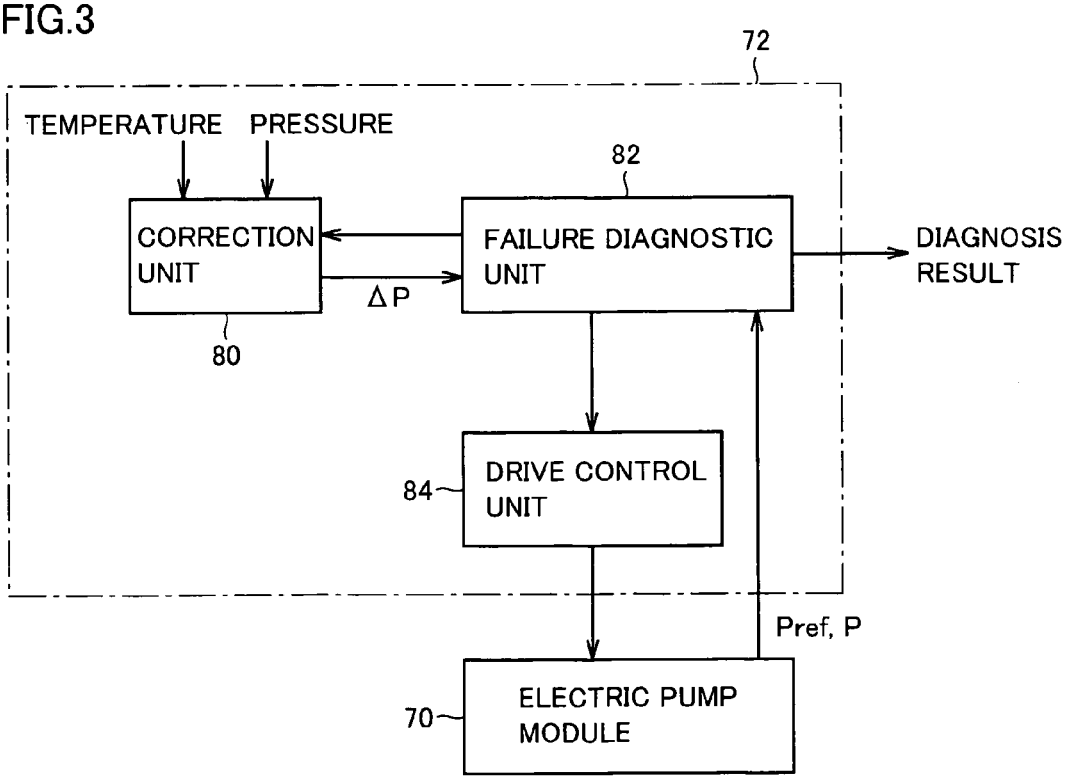
FIG. 3 is a functional block diagram showing a configuration involved in a failure diagnostic process of an ECU shown in FIG. 1.

FIG. 3 is a functional block diagram showing a configuration involved in a failure diagnostic process of ECU 72 shown in FIG. 1.

Referring to FIG. 3, ECU 72 includes a correction unit 80, a failure diagnostic unit 82, and a drive control unit 84. Upon receiving the control command from failure diagnostic unit 82, correction unit 80 obtains the temperature and the pressure at that time detected, for example, by an engine water temperature meter and a system pressure sensor respectively. Correction unit 80 estimates a vapor concentration status in the evaporation path based on the obtained temperature and the pressure. If it is estimated that the vapor concentration is high, correction unit 80 outputs a correction value ΔP for correcting a determination value for failure diagnosis to failure diagnostic unit 82.

Failure diagnostic unit 82 outputs a control command to drive control unit 84 in order to measure a reference pressure Pref using the reference hole in electric pump module 70 after a predetermined time period has passed after stop of engine 10 and the vehicle. Then, upon receiving reference pressure Pref using the reference hole from electric pump module 70, failure diagnostic unit 82 outputs the control command to correction unit 80 and receives correction value ΔP from correction unit 80.

Upon receiving correction value ΔP from correction unit 80, failure diagnostic unit 82 corrects reference pressure Pref measured by electric pump module 70 with correction value ΔP, and employs the corrected value as the determination pressure for failure diagnosis. Then, failure diagnostic unit 82 outputs the control command to drive control unit 84, in order to measure the pressure in the evaporation path in electric pump module 70.

Upon receiving a measured pressure P in the evaporation path from electric pump module 70, failure diagnostic unit 82 compares received measured pressure P with the determination pressure. If measured pressure P is lower than the determination pressure, failure diagnostic unit 82 diagnoses the evaporation path as normal. If measured pressure P is not lower than the determination pressure, failure diagnostic unit 82 diagnoses the evaporation path as abnormal.

Drive control unit 84 controls the electric air pump contained in electric pump module 70. Upon receiving the control command from failure diagnostic unit 82, drive control unit 84 controls the electric air pump contained in electric pump module 70 such that it runs with a predetermined drive force.

It is noted that, in the foregoing description, correction unit 80 corresponds to the "correction means" and failure diagnostic unit 82 corresponds to the "failure diagnostic means."

In ECU 72, failure diagnostic unit 82 starts failure diagnosis after a predetermined time period has passed after stop of engine 10 and the vehicle. Initially, in order to measure reference pressure Pref using the reference hole, failure diagnostic unit 82 outputs the control command to drive control unit 84. Upon receiving the control command from failure diagnostic unit 82, drive control unit 84 controls the electric air pump contained in electric pump module 70, so that reference pressure Pref using the reference hole is measured by electric pump module 70.

Upon receiving reference pressure Pref from electric pump module 70, failure diagnostic unit 82 outputs the control command to correction unit 80. Upon receiving the control command from failure diagnostic unit 82, correction unit 80 obtains the temperature and the pressure at that time. If it is determined that the vapor concentration in the evaporation path is high based on the obtained temperature and the pressure, correction unit 80 outputs correction value ΔP to failure diagnostic unit 82. Upon receiving correction value ΔP from correction unit 80, failure diagnostic unit 82 corrects reference pressure Pref with correction value ΔP, and employs the corrected value as the determination value for failure diagnosis.

Then, failure diagnostic unit 82 outputs the control command to drive control unit 84, in order to measure the pressure in the evaporation path. Upon receiving the control command from failure diagnostic unit 82, drive control unit 84 controls the electric air pump contained in electric pump module 70, whereby the pressure in the evaporation path is measured by electric pump module 70.

Upon receiving measured pressure P in the evaporation path from electric pump module 70, failure diagnostic unit 82 compares measured pressure P with the determination value. If measured pressure P is not lower than the determination value, failure diagnostic unit 82 diagnoses the evaporation path as abnormal. If measured pressure P is lower than the determination value, failure diagnostic unit 82 diagnoses the evaporation path as normal.

Figure 4:
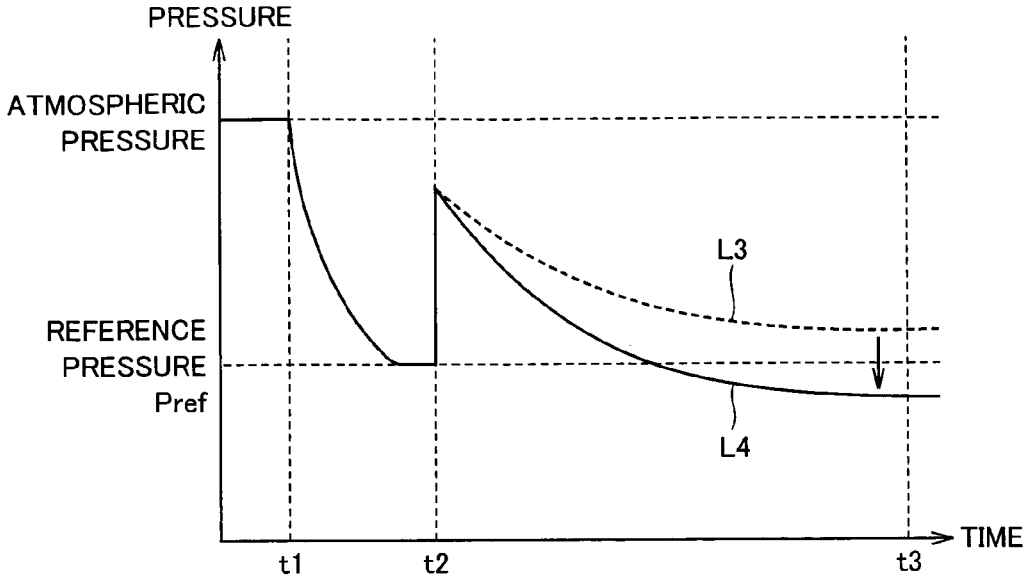
FIG. 4 illustrates a change in pressure when a failure is misdiagnosed due to condensation of fuel vapor in a canister.

FIG. 4 illustrates a change in pressure when a failure is misdiagnosed due to condensation of the fuel vapor in the canister.

Referring to FIG. 4, at time t2 and later, a dotted line L3 represents a change in pressure in the evaporation path when the vapor concentration within the evaporation path is low and condensation of the fuel vapor in the canister is less likely, while a solid line L4 represents a change in pressure in the evaporation path when the vapor concentration within the evaporation path is high and condensation of the fuel vapor in the canister is more likely. Here, it is assumed that a hole larger than the reference hole is present in the evaporation path.

During a period from time t1 to t2, reference pressure Pref using the reference hole is measured. At time t2, when the negative pressure is introduced in the evaporation path by the electric pump module, the pressure in the evaporation path starts to lower. Here, a hole larger than the reference hole is present in the evaporation path. Therefore, when the vapor concentration in the evaporation path is low (dotted line L3), the pressure in the evaporation path does not fall to a level as low as reference pressure Pref. That is, the evaporation path is diagnosed as abnormal.

On the other hand, when the vapor concentration in the evaporation path is high (solid line L4), pressure lowering in the evaporation path due to volume reduction of the fuel vapor caused by a condensation effect at the time of adsorption of the fuel vapor in the canister takes place. Therefore, in spite of presence of the hole larger than the reference hole in the evaporation path, the measured pressure in the evaporation path is lower than reference pressure Pref Consequently, the evaporation path is misdiagnosed as normal.

Figure 5:
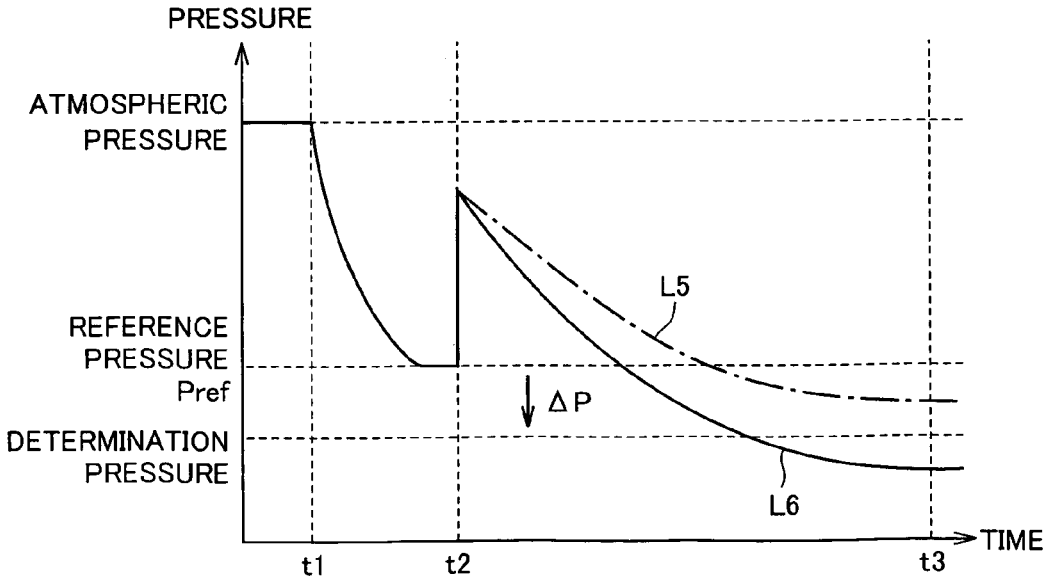
FIG. 5 illustrates failure diagnosis according to the first embodiment when a vapor concentration within an evaporation path is high.

FIG. 5 illustrates failure diagnosis according to the first embodiment when the vapor concentration in the evaporation path is high. A manner in failure diagnosis when the vapor concentration in the evaporation path is low is as shown in FIG. 2.

Referring to FIG. 5, at time t2 and later, a dashed line L5 represents a change in pressure in the evaporation path when the evaporation path is in the abnormal state (where a hole larger than the reference hole is present), while a solid line L6 represents a change in pressure in the evaporation path when the evaporation path is in the normal state.

During a period from time t1 to t2, when reference pressure Pref using the reference hole is measured, failure diagnostic unit 82 employs, as the determination pressure for failure diagnosis, a value obtained by correcting reference pressure Pref in a manner lowering the same by correction value ΔP received from correction unit 80.

At time t2 and later, if the evaporation path is in the abnormal state and if the vapor concentration in the evaporation path is low, measured pressure P does not fall below reference pressure Pref, as shown with dotted line L2 in FIG. 2. On the other hand, as the vapor concentration in the evaporation path is high, the volume of the fuel vapor is reduced due to the condensation effect at the time of adsorption of the fuel vapor in canister 24. Then, as the pressure in the evaporation path is lowered due to volume reduction of the fuel vapor, measured pressure P falls below reference pressure Pref, as shown with dashed line L5.

In the first embodiment, taking into account pressure lowering in the evaporation path due to the condensation effect at the time of adsorption of the fuel vapor in canister 24, the determination pressure for failure diagnosis is corrected so as to be lower than reference pressure Pref by correction value ΔP. Accordingly, when measured pressure P exhibits pressure change shown with dashed line L5, measured pressure P is not lower than the determination pressure, although it is lower than reference pressure Pref. Therefore, failure diagnostic unit 82 diagnoses the evaporation path as abnormal.

On the other hand, if the evaporation path is in the normal state, measured pressure P exhibits pressure change as shown with solid line L6, which is lower than the pressure shown with dashed line L5, and measured pressure P is lower than the determination pressure. Therefore, failure diagnostic unit 82 diagnoses the evaporation path as normal.

Here, as fuel vapor purge system 20 attains a higher temperature or a lower pressure, a larger amount of fuel vapor volatilizes from fuel tank 22 and the vapor concentration in the evaporation path becomes higher. Therefore, in an environment where a large amount of fuel vapor is produced from fuel tank 22, correction amount ΔP is preferably set to a larger value, considering a larger amount of adsorption and condensation of the fuel vapor in canister 24.

Figures 6, 7:
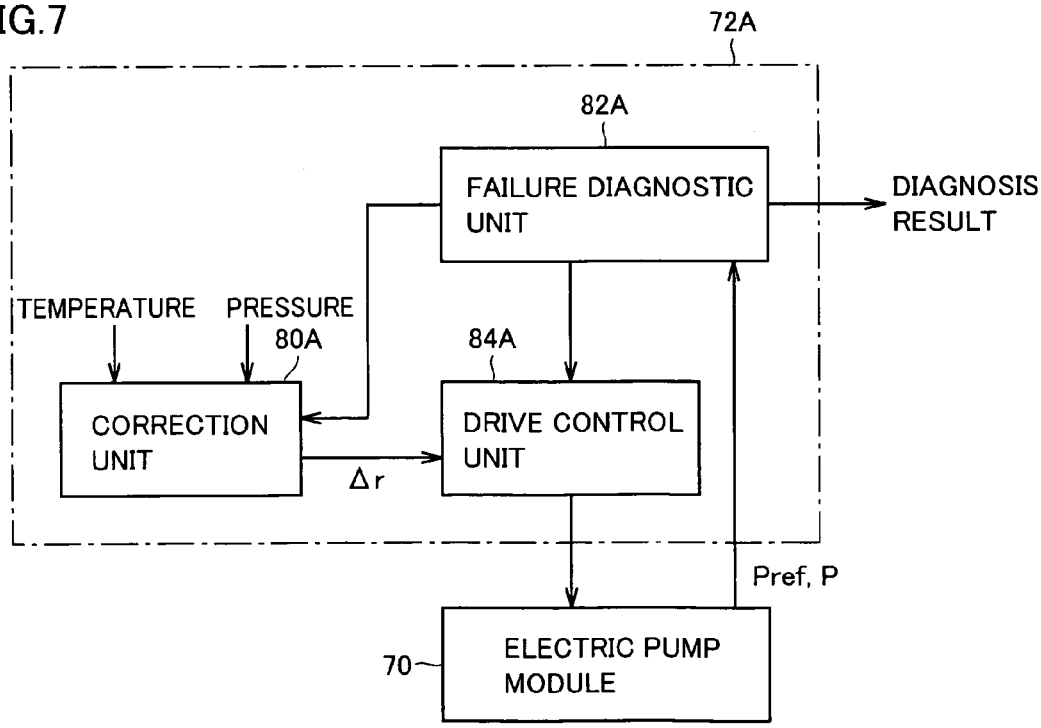
FIG. 6 illustrates a correction amount calculated by a correction unit shown in FIG. 3.
FIG. 7 is a functional block diagram showing a configuration involved in a failure diagnostic process of an ECU according to a second embodiment.

FIG. 6 illustrates correction amounts ΔP calculated by correction unit 80 shown in FIG. 3.

Referring to FIG. 6, as fuel vapor purge system 20 attains a higher temperature or a lower pressure, correction amount ΔP (kPa) is larger. If the temperature is not higher than 10° C. and the pressure is not lower than 110 kPa, correction unit 80 determines that the vapor concentration in the evaporation path is low and sets correction amount ΔP to 0.

Though FIG. 6 shows one example of the correction values, correction amount ΔP is not limited thereto.

As described above, according to the first embodiment, when the concentration of the fuel vapor in the evaporation path is high, correction unit 80 corrects the determination pressure for failure diagnosis in a manner lowering the same. Therefore, pressure lowering in the evaporation path due to condensation of the fuel vapor in canister 24 is compensated for, and misdiagnosis due to the pressure lowering can be prevented.

In addition, according to the first embodiment, correction unit 80 increases the correction amount in the environment where a larger amount of fuel vapor is generated, based on the temperature and the pressure of fuel vapor purge system 20. Therefore, determination accuracy in failure diagnosis can be enhanced and further accurate failure diagnosis can be carried out.

Though failure diagnostic unit 82 corrects the determination value in a manner lowering the same based on the correction value from correction unit 80 in the foregoing description, failure diagnostic unit 82 may correct measured pressure P in the evaporation path received from electric pump module 70 in a manner increasing the same. In this case, a diagnosis result similar to that when the determination value is corrected in a manner lowering the same can also be obtained.

Second Embodiment

According to the first embodiment, when the vapor concentration in the evaporation path is high, in order to take into account pressure lowering due to condensation (adsorption) of the fuel vapor in canister 24, the determination pressure for failure diagnosis is corrected so as to be lower than reference pressure Pref In a second embodiment, however, when the vapor concentration in the evaporation path is high, drive force of electric pump module 70 in measuring the pressure in the evaporation path is lowered, so as to compensate for pressure lowering due to condensation of the fuel vapor in canister 24.

FIG. 7 is a functional block diagram showing a configuration involved in a failure diagnosis process in the ECU in the second embodiment.

Referring to FIG. 7, an ECU 72A in the second embodiment includes a correction unit 80A, a failure diagnostic unit 82A, and a drive control unit 84A. Upon receiving the control command from failure diagnostic unit 82A, correction unit 80A obtains the temperature and the pressure detected, for example, by an engine water temperature meter and a system pressure sensor respectively. Correction unit 80A estimates a vapor concentration status in the evaporation path based on the obtained temperature and the pressure. If it is estimated that the vapor concentration is high, correction unit 80A outputs to drive control unit 84A, a revolution number correction value Δr for lowering the number of revolutions of the electric air pump in electric pump module 70 in measuring the pressure in the evaporation path.

Failure diagnostic unit 82A outputs a control command to drive control unit 84A in order to measure reference pressure Pref using the reference hole in electric pump module 70 after a predetermined time period has passed after stop of engine 10 and the vehicle. Then, upon receiving reference pressure Pref using the reference hole from electric pump module 70, failure diagnostic unit 82A outputs the control command to correction unit 80A and drive control unit 84A, in order to measure the pressure in the evaporation path in electric pump module 70.

Upon receiving measured pressure P in the evaporation path from electric pump module 70, failure diagnostic unit 82A compares received measured pressure P with the determination pressure represented by reference pressure Pref. If measured pressure P is lower than the determination pressure, failure diagnostic unit 82A diagnoses the evaporation path as normal. If measured pressure P is not lower than the determination pressure, failure diagnostic unit 82A diagnoses the evaporation path as abnormal.

Drive control unit 84A controls the electric air pump contained in electric pump module 70. Upon receiving the control command for measuring reference pressure Pref using the reference hole from failure diagnostic unit 82A, drive control unit 84A drives the electric air pump contained in electric pump module 70 with a predetermined drive force.

Moreover, upon receiving the control command for measuring the pressure in the evaporation path from failure diagnostic unit 82A, drive control unit 84A lowers the revolution number command by revolution number correction value Δr received from correction unit 80A from the revolution number command at the time of measurement of reference pressure Pref using the reference hole, so as to control the electric air pump.

It is noted that, in the foregoing description, correction unit 80A corresponds to the "correction means" and failure diagnostic unit 82A corresponds to the "failure diagnostic means."

In ECU 72A, failure diagnostic unit 82A starts failure diagnosis after a predetermined time period has passed after stop of engine 10 and the vehicle. In order to measure reference pressure Pref using the reference hole, failure diagnostic unit 82A outputs the control command to drive control unit 84A. Upon receiving the control command from failure diagnostic unit 82A, drive control unit 84A controls the electric air pump contained in electric pump module 70 such that it runs with a predetermined drive force, whereby reference pressure Pref using the reference hole is measured by electric pump module 70.

Upon receiving reference pressure Pref from electric pump module 70, failure diagnostic unit 82A outputs the control command to correction unit 80A and drive control unit 84A. Upon receiving the control command from failure diagnostic unit 82A, correction unit 80A obtains the temperature and the pressure at that time. If it is determined that the vapor concentration in the evaporation path is high based on the obtained temperature and the pressure, correction unit 80A outputs revolution number correction value Δr for the electric air pump to failure diagnostic unit 82A.

Upon receiving the control command from failure diagnostic unit 82A, drive control unit 84A controls the electric air pump contained in electric pump module 70, by lowering the revolution number command for the electric air pump by revolution number correction value Δr from the revolution number command at the time of measurement of reference pressure Pref, whereby the pressure in the evaporation path is measured by electric pump module 70.

Upon receiving measured pressure P in the evaporation path from electric pump module 70, failure diagnostic unit 82A compares received measured pressure P with the determination value represented by reference pressure Pref. If measured pressure P is not lower than the determination value, failure diagnostic unit 82A diagnoses the evaporation path as abnormal. If measured pressure P is lower than the determination value, failure diagnostic unit 82A diagnoses the evaporation path as normal.

Figures 8, 9:
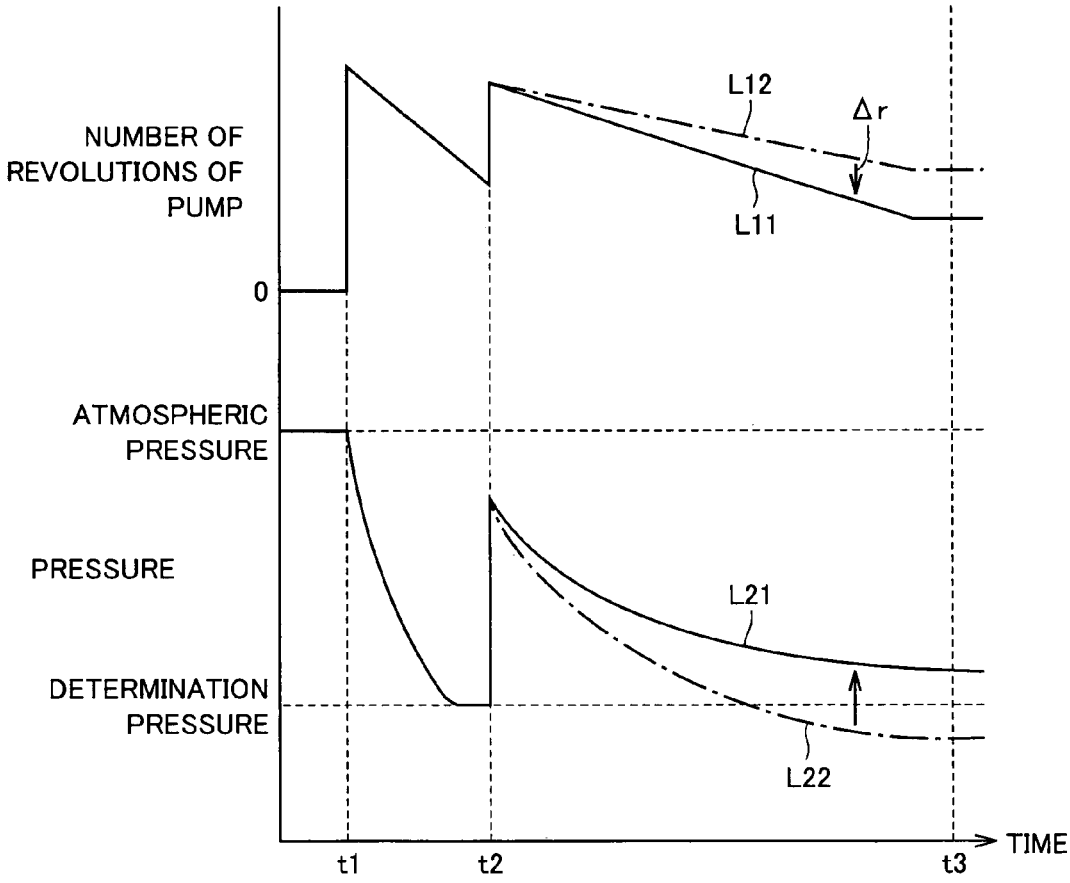
FIG. 8 illustrates failure diagnosis according to the second embodiment when a vapor concentration within an evaporation path is high.
FIG. 9 shows a revolution number correction value $\Delta r$ calculated by the correction unit shown in FIG. 7.

FIG. 8 illustrates failure diagnosis according to the second embodiment when the vapor concentration in the evaporation path is high. FIG. 8 illustrates a state where a hole larger than the reference hole is present in the evaporation path.

Referring to FIG. 8, at time t2 and later, a solid line L11 and a dashed line L12 show the number of revolutions of the electric air pump contained in electric pump module 70, while a solid line L21 and a dashed line L22 show a pressure in the evaporation path. In addition, solid lines L11 and L21 show the number of revolutions of the pump and the pressure in the evaporation path respectively when the revolution number command for the electric air pump is corrected in measuring the pressure in the evaporation path, while dashed lines L12 and L22 show the number of revolutions of the pump and the pressure in the evaporation path respectively if the revolution number command for the electric air pump is not corrected in measuring the pressure in the evaporation path.

During a period from time t1 to time t2, reference pressure Pref using the reference hole is measured. Here, failure diagnostic unit 82 employs reference pressure Pref measured by electric pump module 70 as the determination pressure for failure diagnosis. The number of revolutions of the pump is decreased as the pressure lowers, because the number of revolutions of the pump is decreased in accordance with a load increased as the pressure is lowered.

At time t2 and later, the pressure in the evaporation path is measured by electric pump module 70. As shown with dashed line L12, if pressure lowering in the evaporation path due to condensation of the fuel vapor in canister 24 is not taken into account and if the number of revolutions of the electric air pump is not corrected, the pressure in the evaporation path falls below the determination pressure as shown with dashed line L22, and failure diagnostic unit 82A of ECU 72A misdiagnoses the evaporation path as normal.

On the other hand, according to the second embodiment, as shown with solid line L11, drive control unit 84A in ECU 72A lowers the revolution number command for the electric air pump by Δr, taking into account pressure lowering in the evaporation path due to condensation of the fuel vapor in canister 24. Therefore, as shown with solid line L21, the pressure in the evaporation path does not fall below the determination pressure, and failure diagnostic unit 82A of ECU 72A diagnoses the evaporation path as abnormal.

Here, as in the first embodiment, in an environment where a large amount of fuel vapor is produced from fuel tank 22, revolution number correction value Δr for the electric air pump is preferably set to a larger value, considering a larger amount of adsorption and condensation of the fuel vapor in canister 24.

FIG. 9 shows revolution number correction values Δr calculated by correction unit 80A shown in FIG. 7.

Referring to FIG. 9, as fuel vapor purge system 20 attains a higher temperature or a lower pressure, revolution number correction value Δr (%) for lowering the number of revolutions of the electric air pump is larger. If the temperature is not higher than 10° C. and the pressure is not lower than 110 kPa, correction unit 80A determines that the vapor concentration in the evaporation path is low and sets revolution number correction value Δr to 0.

Though FIG. 9 also shows one example of the correction values, revolution number correction value Δr is not limited thereto.

As described above, according to the second embodiment, when the concentration of the fuel vapor in the evaporation path is high, the number of revolutions of the electric air pump generating the negative pressure in the evaporation path is lowered. Therefore, pressure lowering in the evaporation path due to condensation of the fuel vapor at the time of adsorption of the fuel vapor in canister 24 is compensated for, and misdiagnosis due to the pressure lowering can be prevented.

In addition, according to the second embodiment as well, correction unit 80A increases the correction amount in the environment where a larger amount of fuel vapor is generated, based on the temperature and the pressure of fuel vapor purge system 20. Therefore, according to the second embodiment, determination accuracy in failure diagnosis can be enhanced and further accurate failure diagnosis can be carried out.

In each embodiment described above, the vapor concentration in the evaporation path has been estimated based on the temperature and the pressure of fuel vapor purge system 20. A concentration sensor for detecting the vapor concentration in the evaporation path, however, may separately be provided, in order to directly detect the vapor concentration.

In addition, though electric pump module 70 has been described as a device generating a negative pressure in the evaporation path in failure diagnosis, the present invention is applicable to an example where the pressure in the evaporation path is higher than outside air, without limited to an example where the pressure applied in the evaporation path in failure diagnosis is the negative pressure.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A failure diagnostic apparatus for a fuel vapor purge system adsorbing in a canister fuel vapor generated in a fuel tank and purging the adsorbed fuel vapor into an intake system, comprising:

pressure difference generation means for generating, when failure diagnosis is executed, a pressure difference between respective pressures inside and outside a fuel vapor path including said fuel tank and said canister;

failure diagnostic means for comparing, with a predetermined determination pressure, the pressure inside said fuel vapor path when said pressure difference generation means generates said pressure difference, for conducting said failure diagnosis to determine whether failure occurs or not based on result of the comparison; and correction means for correcting said predetermined determination pressure in a manner lowering said predetermined determination pressure when a concentration of the fuel vapor within said fuel vapor path is higher than a predetermined value.

2. The failure diagnostic apparatus for a fuel vapor purge system according to claim 1, wherein said correction means increases a correction amount as a temperature is higher.

3. The failure diagnostic apparatus for a fuel vapor purge system according to claim 1, wherein said correction means increases a correction amount as a pressure within said fuel vapor path is lower.

4. The failure diagnostic apparatus for a fuel vapor purge system according to claim 1, further comprising concentration detection means for detecting said concentration of the fuel vapor within said fuel vapor path, wherein said correction means determines whether said concentration of the fuel vapor within said fuel vapor path is higher than said predetermined value based on a value detected by said concentration detection means.

5. The failure diagnostic apparatus for a fuel vapor purge system according to claim 4, wherein said correction means increases a correction amount as said value detected by said concentration detection means is larger.

6. The failure diagnostic apparatus for a fuel vapor purge system according to claim 1, wherein said pressure difference generation means generates a negative pressure, relative to outside air, within said fuel vapor path.

7. A fuel vapor purge apparatus comprising the failure diagnostic apparatus for the fuel vapor purge system according to claim 1.

8. A combustion engine comprising the failure diagnostic apparatus for the fuel vapor purge system according to claim 1.

* * * * *